United States Patent [19]

Keeny et al.

[11] Patent Number: 4,530,687

[45] Date of Patent: Jul. 23, 1985

[54] DUAL CUTOFF SYSTEM HAVING DIVERGING WEB PATHS

[75] Inventors: Thomas R. Keeny, Lindenwold; William W. Harris, Jr., Turnersville, both of N.J.

[73] Assignee: Molins Machine Company, Inc., Cherry Hill, N.J.

[21] Appl. No.: 426,520

[22] Filed: Sep. 29, 1982

[51] Int. Cl.[3] ..... B65H 23/32

[52] U.S. Cl. ..... 493/361; 83/107; 83/303; 493/363

[58] Field of Search ..... 493/361, 363, 355, 62; 83/105-107, 302, 301, 303, 479; 156/470-473, 205, 207; 226/109, 110, 199

[56] References Cited

U.S. PATENT DOCUMENTS

| | | | |
|---|---|---|---|
| 1,997,608 | 4/1935 | Swift | 83/303 |
| 2,184,522 | 12/1939 | Greenwood | 83/303 |
| 2,257,818 | 10/1941 | Shields | 83/303 X |
| 3,296,908 | 1/1967 | Shields | 83/303 |
| 3,679,117 | 7/1972 | Moss | 226/109 X |
| 3,898,900 | 8/1975 | Schmermund | 83/303 X |
| 4,188,861 | 2/1980 | Kroeze et al. | 93/93 |
| 4,195,539 | 4/1980 | Goburn | 493/355 X |

*Primary Examiner*—David Simmons

*Attorney, Agent, or Firm*—Seidel, Gonda & Goldhammer

[57] ABSTRACT

A dual cutoff machine system is provided for cutting two continuously moving rigid webs into sheets by way of first and second cutting devices at different elevations. The cutting devices are along first and second web paths which diverge in a downstream direction.

10 Claims, 1 Drawing Figure

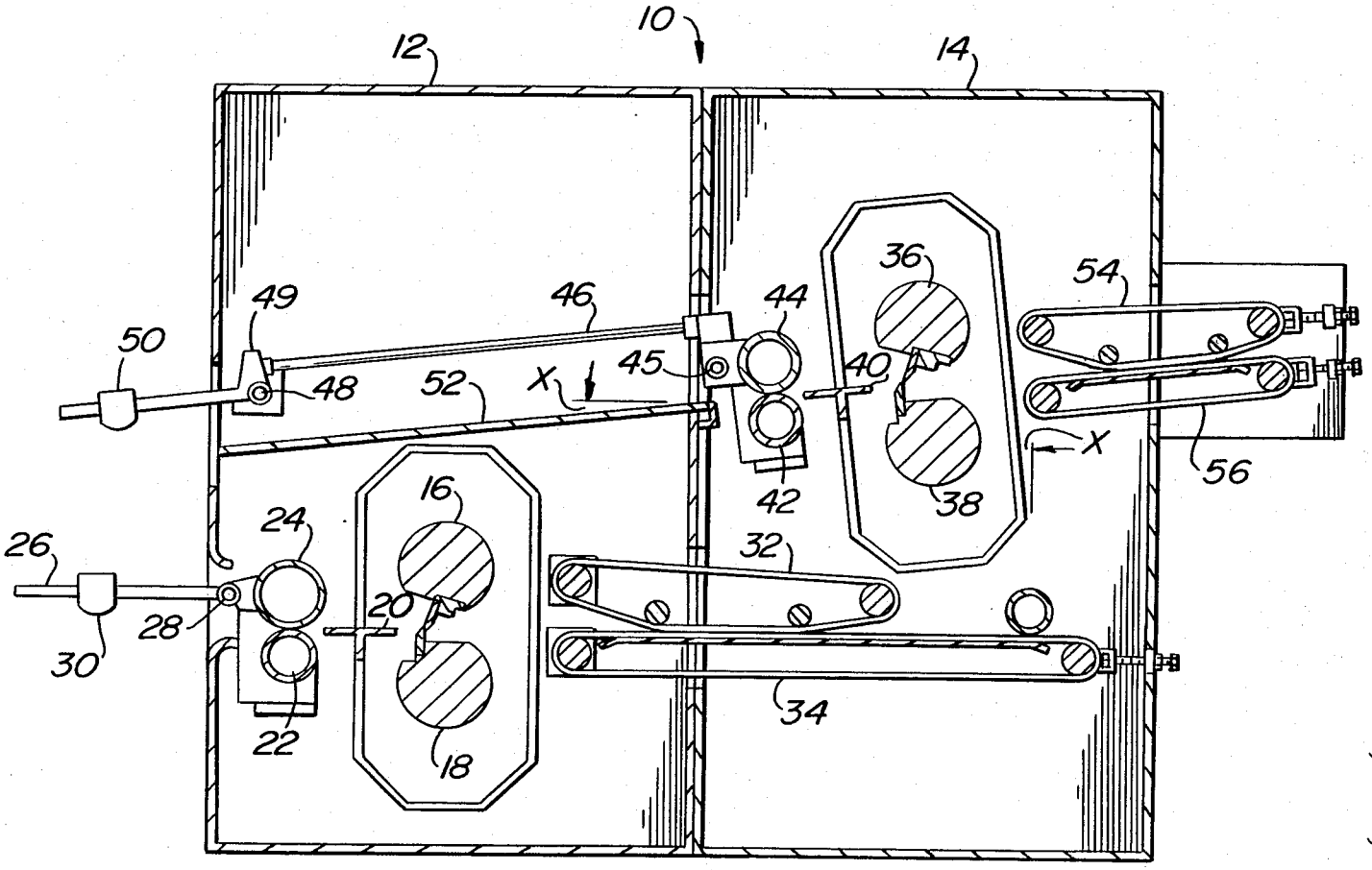
10
12
14
16
18
20
22
24
26
28
30
32
34
36
38
40
42
44
45
46
48
49
50
52
54
56
X
X

DUAL CUTOFF SYSTEM HAVING DIVERGING WEB PATHS

BACKGROUND OF THE INVENTION

A dual cutoff system is per se old and well known in the corrugator art for simultaneously cutting two continuously moving webs of corrugated paper board into sheets as the webs move along first and second paths. The first and second paths have always been parallel donwstream from the cutoff machine. Stacking apparatus, such as that disclosed in U.S. Pat. No. 4,188,861 is conventionally arranged to receive the sheets. The stacking conveyors are generally inclined. There is a tendency of the sheets to buckle when being transferred from the horizontally disposed conveyors downstream of the cutoff machine onto the inclined conveyors of the stacking conveyor.

There is also a tendency for a rigid web such as corrugated paper board to buckle when being fed to the upper knife station in a dual cutoff machine. This results from the fact that the approach to the knife station is inclined but the knife station and the downstream conveyors are horizontal.

The present invention is directed to a solution of the above problems.

SUMMARY OF THE INVENTION

A dual cutoff machine system comprising discrete upper and lower cutoff units at different elevations for cutting discrete webs moving along an upper web path and a lower web path. Each web path includes a discrete conveyor downstream from each cutoff unit. The first upper web path is inclined relative to the horizontal by an acute angle less than about 15°.

Various objects of the present invention and advantages are set forth hereinafter.

For the purpose of illustrating the invention, there is shown in the drawings a form which is presently preferred; it being understood, however, that this invention is not limited to the precise arrangements and instrumentalities shown.

The drawing illustrates a sectional view of a dual cutoff machine in accordance with the present invention.

DETAILED DESCRIPTION

Referring to the drawing in detail, wherein like numerals indicate like elements, there is shown in FIG. 1 a dual cutoff machine in accordance with the present invention designated generally as 10.

The machine 10 includes discrete frames 12 and 14. If desired, one single frame may be provided instead of two separate frames. Frame 12 supports a first cutoff unit including knife cylinders 16 and 18 rotatively supported by the frame 12. Means for driving the cylinders is not shown and is conventional. Each knife cylinder has a blade for cooperation with a mating blade on the other knife cylinder.

A horizontally disposed guide plate 20 is supported in any convenient manner for directing a first web to the first cutoff unit. Upstream of the first cutoff unit there is provided means for feeding the first web from left to right in the drawing. The feeding means includes a bottom feed roller 22 driven by a motor not shown and a top idler roller 24. Roller 24 is supported by a pair of levers 24. Only one of the levers is shown. Levers 26 are each pivotable about a pivot 28 intermediate their ends.

An adjustable weight 30 is provided along the length of lever 26. The position of the weight determines the pressure applied to the first web by the idler roller 24.

Downstream from the first cutoff unit there is provided a conveyor means for conveying the sheets cut at the first cutoff unit. As illustrated, the cutoff means includes a pair of sandwich conveyors 32, 34. Conveyors 32, 34 convey the cut sheets horizontally for delivery to the lower conveyor of a stacker or to a right angle delivery.

Frame 14 supports a second cutoff unit which includes knife cylinders 36 and 38. A guide plate 40 is provided for feeding the second web to the knife cylinders. The second cutoff unit is identical with the first cutoff unit except that it is angled with respect to the vertical by an acute angle less than 15°. A preferred angle is 6° and is designated "X" in the drawing.

A feed means is provided for feeding the second web to the second cutoff unit. The feed means includes a bottom feed roller 42 and a top roller 44. Roller 44 is an idler roller supported by an L-shaped arm pivotable about pivot 45. The end of the arm remote from the idler roller is pivotable connected to one end of arm 46. The other end of arm 46 is pivotable connected to a L-shaped arm 49. Arm 49 pivots about pivot 48 and has an adjustable weight 50 thereon. Adjustment of the location of weight 50 adjusts the pressure of roller 44 on the second web.

Downstream from the second cutoff unit there is provided a conveyor means. The preferred conveyor means is a pair of sandwich conveyors 54 and 56 inclined with respect to the horizontal by the same angle "X". Upstream of the feed roller 42 there is provided a feed plate 52. Plate 52 is supported by the frame 12 and is inclined with respect to the horizontal by angle "X".

In use, a wide web is slit into narrower first and second webs by a slitter. Alternatively, the wide web may be slit and scored by a slitter scorer. The discrete webs are then separately fed along the web paths associated with the first and second cutoff units. The webs are cut into sheets of different length at the first and second cutoff units. Alternatively, the webs may be a different width and cut into sheets of the same length. The sheets moving along the lower web path may be fed to a right angle conveyor and processed in a normal manner. The sheets produced along the upper web path continue at the same angle "X" with respect to the horizontal along the conveyors 54, 56 to a matching inclined conveyors of a stacker.

There is no abrupt change in the upper web path immediately upstream of the upper cutoff unit nor is there any such abrupt change when transferring from the conveyors 54, 56 to the stacker conveyor. Hence, buckling of the web and/or cut sheets is avoided. Thus, buckling is avoided at the transition onto the stacker conveyor even though the stacker conveyor runs at a slower speed so that the sheets may be shingled. The object has been accomplished without requiring the need for additional floor space. The first and second cutoff units need not be staggered as illustrated but may be disposed one above the other.

The present invention may be embodied in other specific forms without departing from the spirit or essential attributes thereof and, accordingly, reference should be made to the appended claims, rather than to the foregoing specification, as indicating the scope of the invention.

We claim:

1. A dual cut off system comprising discrete upper and lower cut off units for cutting moving webs along an upper path and a lower horizontal web path, each web path including a discrete conveyor downstream from each cut off unit for conveying sheets along its associated path, the upper web path being inclined upwardly relative to the horizontal by an acute angle less than 15°, and the upper cut off unit being angled with respect to the vertical by an amount corresponding to said acute angle.

2. A system in accordance with claim 1 wherein said angle is about 6°.

3. A system in accordance with claim 1 including a web support plate upstream from said upper cutoff unit, said plate being inclined with respect to the horizontal by the same acute angle.

4. A system in accordance with claim 3 including feed roller means for feeding the upper web to the nip between mating blades of the upper cutoff unit.

5. A system in accordance with claim 3 wherein said inclined plate is disposed above the first cutoff unit, said cutoff units being staggered with the upper cutoff unit being downstream from the lower cutoff unit.

6. In a dual cut off machine system for cutting two continuously moving corrugated paperboard webs into sheets comprising a first cut off unit provided with a first cutting means adapted to be disposed transversely to a first moving web, first web feed means upstream from said first cutting means to feed a first web thereto, first conveyor means downstream from said first cutting means to convey cut sheets away from said first cutting means, said first feed means and said first conveyor means defining a first web path which is substantially horizontal, a second cutting means disposed at an elevation above said first cutting means, second web feed means upstream from said second cutting means to feed a second web thereto, second conveyor means downstream from said second cutting means to convey sheets away from said second cutting means, said second web feed means and said second conveyor means being inclined at an acute angle with respecct to the vertical to define a second web path which is inclined upwardly in a downstream direction.

7. A system in accordance with claim 6 wherein the second cutting means is inclined with respect to the vertical by an amount corresponding to the angle by which said second web path is inclined with respect to the horizontal.

8. A system in accordance with claim 6 wherein said second web path diverges from said first web path by an acute angle between about 6° and 15°.

9. A system in accordance with claim 6 wherein said second conveyor means is an endless sandwich conveyor for contacting opposite surfaces of a sheet being conveyed along the second web path.

10. A system in accordance with claim 6 wherein said second cutting means is downstream from said first cutting means.

* * * * *